United States Patent [19]

Weiser

[11] Patent Number: 4,702,384

[45] Date of Patent: Oct. 27, 1987

[54] SCREW THREADED CLOSURE WITH ELASTOMERIC GRIP BAND

[76] Inventor: Sylvan W. Weiser, 10 Timothy Ct., Monsey, N.Y. 10952

[21] Appl. No.: 905,520

[22] Filed: Sep. 10, 1986

[51] Int. Cl.[4] ..... B65D 41/04

[52] U.S. Cl. ..... 215/295

[58] Field of Search ..... 215/295, 329; 206/805; 220/85 K

[56] References Cited

U.S. PATENT DOCUMENTS 1,070,748 8/1913 Stollberg ..... 215/329
2,390,561 12/1945 Staples ..... 215/329
3,851,762 12/1974 Liblick ..... 206/805 X
4,627,548 12/1986 Thompson ..... 215/295

*Primary Examiner*—Donald F. Norton
*Attorney, Agent, or Firm*—Howard C. Miskin

[57] ABSTRACT

A screw cap closure includes a metal body member with a circular top wall and a depending skirt wall having screw engageable interior projections and in order to facilitate the twisting of the cap an elastomeric flat band encircles the skirt wall and is under peripheral tension and is spaced from the top and bottom edges of the skirt wall. The outside face of the band has a high coefficient of friction.

3 Claims, 3 Drawing Figures

FIG. 1
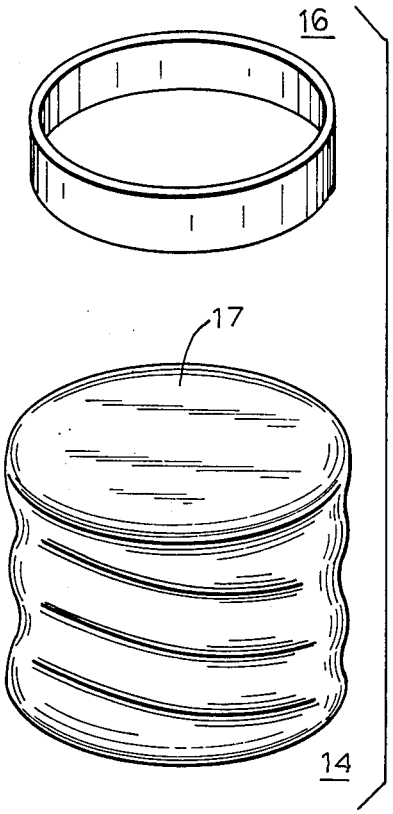
FIG. 2
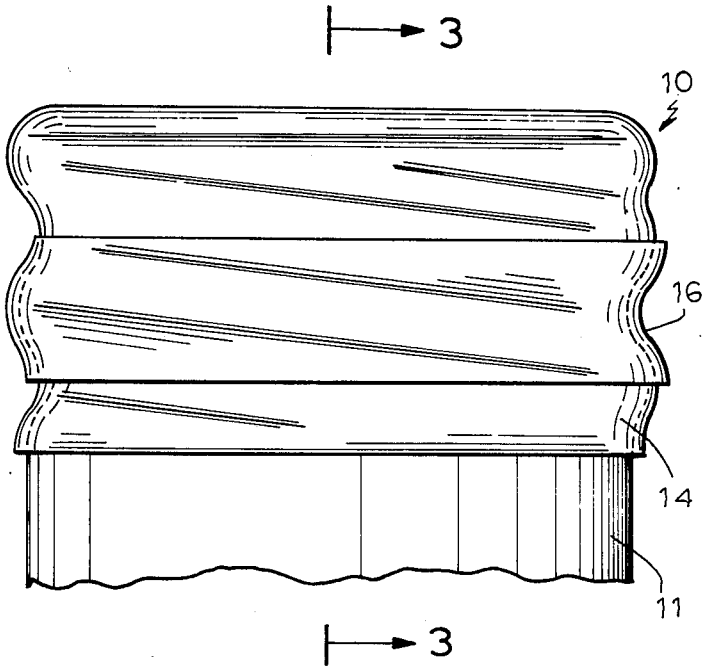
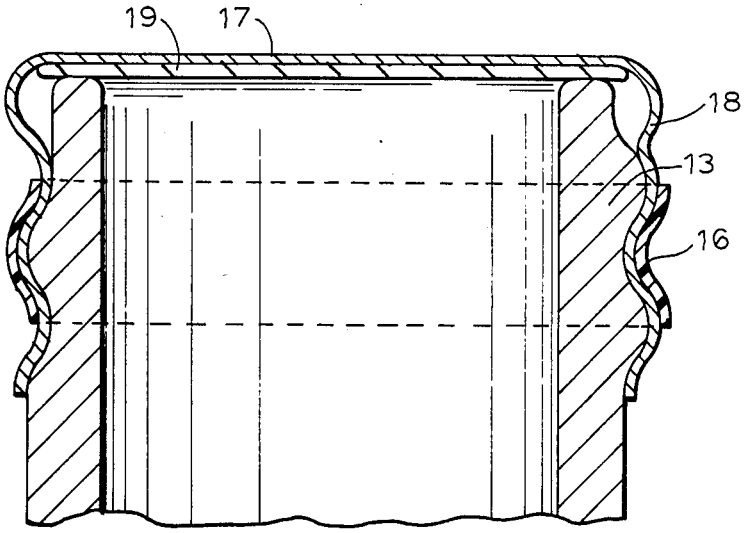
FIG. 3

SCREW THREADED CLOSURE WITH ELASTOMERIC GRIP BAND

BACKGROUND OF THE INVENTION

The present invention relates generally to improvements in container closures and it relates particularly to an improved screw or twist type closure cap for bottles, jars and the like.

Bottles, jars and other containers are conventionally provided with twist type closures usually in the form of metal caps having a helical ridge or recess formed in the inside face of its cylindrical wall to permit the tightening and loosening of the closure attendant to the sealing or opening of the bottle or jar. In as much as the container should be tightly sealed by the closure to protect the container contents against contamination and exposure to the ambient atmosphere it is often difficult to manually twist the closure cap to separate it from the container or to effect a reliable seal. This is due to the slippage between the operator's finger or hand and the peripheral surface of the closure which at best has a low friction coefficient or has sharp projections which may cause injury to the person. The conventional twist type closure cap possesses additional drawbacks and has much to be desired.

SUMMARY OF THE INVENTION

A principal object of the present invention is to provide an improved receptacle closure device.

Another object of the present invention is to provide an improved twist or screw type closure cap for bottles, jars and the like.

Still another object of the present invention is to provide an improved twist or screw type closure cap in which the manual application of a high twisting torque is greatly enhanced to facilitate the tightening and loosening of the closure cap on an associated receptacle.

A further object of the present invention is to provide an improved closure device of the above nature characterized by its low cost, attractive appearance, high reliability, ease and convenience of use and operation and great versatility and adaptability.

The above and other objects of the present invention will become apparent from a reading of the following description taken in conjunction with the accompanying drawing which illustrates a preferred embodiment thereof.

A closure device in accordance with the present invention includes a metal body member having a circular top wall and a skirt wall depending from the periphery of the top wall and having coupling projections on its inside face and a band formed of a soft compressible organic polymeric material encircling and rotatable with the skirt wall and having its top and bottom peripheral edges located respectively above and below the top and bottom edges of the skirt wall, the outside face of the top wall being exposed.

Advantageously the skirt wall encircling band is formed of natural or synthetic rubber and in its preferred form the band is a broad rubber band which is peripherally stretched and applied to the body member skirt wall and permitted to contract to tightly engage the skirt wall, the band in its contracted condition being under peripheral tension and under radial pressure on the skirt wall outside face. The inside face of the band by reason of its high coefficient of friction is prevented from slipping around the skirt wall and there is a minimum or no slippage between the finger and the band which is radially compressed by the fingers and resists any slipping of the fingers along the band attendant to the twisting thereof so that the closure device can be reliably manually turned to effect its opening or closing on an associated bottle or jar. The outside face of the skirt wall or the inside face of the rubber band may be roughened or provided with projections or recesses as may be the outside face of the rubber band.

The improved closure device is inexpensive, attractive, easy and convenient to produce, easy to operate and of great versatility and adaptability.

BRIEF DESCRIPTION OF THE DRAWING

FIG. 1 is an exploded front perspective view of a closure device embodying the present invention;

FIG. 2 is a front elevational view of the assembled device shown applied to a bottle opening; and FIG. 3 is a sectional view taken along line 3—3 in FIG. 2.

DESCRIPTION OF THE PREFERRED EMBODIMENT

Referring now to the drawing which illustrates a preferred embodiment of the present invention the reference numeral 10 generally designates the improved closure device in the form of a screw cap as applied to a glass bottle 11 for sealing the opening therein. It should be understood however that the device may be in the form of any screw type closure and applied to receptacles other than bottles, such as jars, cans, plastic containers and the like. In the illustrated embodiment the bottle 11 has formed in the outside face of its neck portion 12 a thread defining helical rounded ridge 13 delineating a helical valley.

The closure device 10 includes a cap shaped body member 14 and a grip member 16. The body member 14 is formed of a relatively hard incompressible material and is advantageously formed of sheet metal such as aluminum or the like although it may be formed of a rigid preferably thermoset synthetic organic polymeric material.

Body member 14 includes a flat circular top wall 17 and a skirt wall 18 integrally formed with and depending from the periphery of top wall 17. The skirt wall 18 is vertically undulate and provided with rounded helical peripherally extending alternate ridges and valleys with its inside face mating or complementing the bottle neck thread 13 so that the closure device or cap 10 is tightened or loosened by twisting it in engagement with the bottle neck. It should be understood that the inside face of the body member 14 may be provided with other twist type coupling elements or projections which are conventional and well known instead of the helical thread. Superimposed on the underface of body member top tall 17 is a disc shaped sealing gasket 19 formed of any suitable material.

The band 16 is employed in accordance with the present invention to facilitate the manual application of a high torque to closure cap body member 14 for turning the closure device 10 against high resistance and is advantageously formed of an elastomeric material such as an artificial or natural rubber. Band 16 is of a peripheral length in its unstretched state less than that of skirt wall 18 and is of a width less than the height of skirt wall 18. The band 16 is preferrably of substantial thickness and may have opposite faces which are roughened or provided with recesses or projections and in any event has a high coefficient of friction to substantially eliminate any slippage between the band 16 and skirt wall 18 and between the operator's fingers and the band.

In assembling the band 16 and the body member 14, the band 16 is stretched and slipped over the skirt wall 18 to an area intermediate the top and bottom edges of the skirt wall and is then released. The band 16 then contracts and tightly engages the outside face of skirt wall 18 and remains under peripheral tension and applies radial inwardly directed pressure to skirt wall 18. The upper and lower edges of band 16 are below and above respectively of the upper and lower edges of skirt wall 18.

In the use of the closure cap 10 in tightening or loosening it on bottle neck 13 it is manually grasped on the outside face of band 16 and squeezed and twisted clockwise or counterclockwise. Upon squeezing the band 16 it is compressed in the grasped area to effect a tight engagement at the interface of skirt wall 18 and band 16 and at the interface of the operator's fingers and band 16 so that the twisting or turning of the closure cap 10 can be easily effected with a minimum of effort. Little or no peripheral stress is applied to band 16. Moreover, in as much as the top face of body member top wall is fully exposed it may bear any desired information which is visually accessible.

While there has been described and illustrated a preferred embodiment of the present invention it is apparent that numerous alterations, omissions and additions may be made without departing from the spirit thereof.

I claim:

1. In combination with a receptacle screw cap formed of a stiff material and including a circular top wall and skirt wall depending from the periphery of said top wall, a separate grip member tightly engaging the outer face of said skirt wall and comprising an elastically stretched cylindrical elastomeric band of a width less than the height of said skirt wall and a circumference in its untensioned state less than that of said skirt wall, said band encircling said skirt wall and being under peripheral tension and pressing radially inwardly on the outside face of said skirt wall whereby to inhibit slippage between said band and skirt wall, the upper and lower edges of said band being spaced respectively below and above the upper and lower edges of said skirt wall.

2. The combination of claim 1 wherein said grip member is defined by a substantially flat annular band and said screw cap is formed of metal with ridges and grooves formed in the outside face of said skirt wall.

3. The combination of claim 1 wherein said band hugs and assumes the contour of the outside face of said skirt wall.

* * * * *